US011117005B2

(12) United States Patent
Teoldi et al.

(10) Patent No.: US 11,117,005 B2
(45) Date of Patent: Sep. 14, 2021

(54) DEVICE FOR DISPENSING A PRESSURIZED MATERIAL

(71) Applicant: ARIANEGROUP SAS, Paris (FR)

(72) Inventors: Raphaël Teoldi, Saucats (FR); Marc Letourneur, Le Haillan (FR)

(73) Assignee: ARIANEGROUP SAS, Paris (FR)

( * ) Notice: Subject to any disclaimer, the term of this patent is extended or adjusted under 35 U.S.C. 154(b) by 91 days.

(21) Appl. No.: 16/337,214

(22) PCT Filed: Sep. 27, 2017

(86) PCT No.: PCT/FR2017/052598

§ 371 (c)(1),
(2) Date: Mar. 27, 2019

(87) PCT Pub. No.: WO2018/060594

PCT Pub. Date: Apr. 5, 2018

(65) Prior Publication Data

US 2019/0290949 A1 Sep. 26, 2019

(30) Foreign Application Priority Data

Sep. 28, 2016 (FR) ..... 1659163

(51) Int. Cl.
*B05B 15/55* (2018.01)
*A62C 13/22* (2006.01)
(Continued)

(52) U.S. Cl.
CPC ..... *A62C 13/22* (2013.01); *A62C 35/023* (2013.01); *A62C 3/07* (2013.01); *B05B 7/0006* (2013.01);
(Continued)

(58) Field of Classification Search
CPC ..... A62C 13/22; A62C 35/023; A62C 3/07; B05B 15/55; B05B 7/0006; B05B 9/0838;
(Continued)

(56) References Cited

FOREIGN PATENT DOCUMENTS

DE 10 2006 032504 A1 1/2008
DE 102006032504 * 1/2008
(Continued)

OTHER PUBLICATIONS

International Search Report as issued in International Patent Application No. PCT/FR2017/052598, dated Jan. 16, 2018.

*Primary Examiner* — Qingzhang Zhou
(74) *Attorney, Agent, or Firm* — Pillsbury Winthrop Shaw Pittman LLP

(57) ABSTRACT

A device for dispensing a pressurized material, includes a body defining a pressurizing chamber containing a gas generator, and a tank containing the material to be dispensed, the tank being defined by an end wall having an outlet orifice. The device includes a piston, to move inside the body, separating the pressurizing chamber from the tank, the gas generator to trigger the dispensing of the material to the outside of the body through the outlet orifice by causing the piston to pass from a material-storage, first position to an end-of-material-dispensing, second position in which the piston faces the end wall. The piston, when in the first position, presents a housing that is closed by a fragile portion beside the pressurizing chamber and that is open beside the tank, the housing containing a striker element that is held in the housing and that defines a channel opening out into the tank.

12 Claims, 7 Drawing Sheets

(51) Int. Cl.

| | |
|---|---|
| ***A62C 35/02*** | (2006.01) |
| *A62C 3/07* | (2006.01) |
| *B05B 7/00* | (2006.01) |
| *B05B 9/08* | (2006.01) |
| *B65D 83/34* | (2006.01) |
| *B65D 83/50* | (2006.01) |
| *B65D 83/64* | (2006.01) |

(52) U.S. Cl.
CPC ..... *B05B 9/0838* (2013.01); *B05B 9/0844* (2013.01); *B05B 15/55* (2018.02); *B65D 83/34* (2013.01); *B65D 83/50* (2013.01); *B65D 83/643* (2013.01)

(58) Field of Classification Search
CPC ..... B05B 9/0844; B65D 83/34; B65D 83/50; B65D 83/643
See application file for complete search history.

(56) References Cited

FOREIGN PATENT DOCUMENTS

| | | | |
|---|---|---|---|
| FR | 2 936 715 | A1 | 4/2010 |
| WO | WO 03/068320 | A1 | 8/2003 |
| WO | WO 2009/056574 | A1 | 5/2009 |

* cited by examiner

DEVICE FOR DISPENSING A PRESSURIZED MATERIAL

CROSS REFERENCE TO RELATED APPLICATIONS

This application is the U.S. National Stage of PCT/FR2017/052598, filed Sep. 27, 2017, which in turn claims priority to French Patent Application No. 1659163 filed Sep. 28, 2016, the entire contents of all applications are incorporated herein by reference in their entireties.

BACKGROUND OF THE INVENTION

The invention relates to a device for dispensing a pressurized material.

In the state of the art, it is known to use devices for dispensing a liquid material, which devices present two chambers separated by a piston.

Such devices comprise a first chamber containing a gas generator and a second chamber in which the liquid for dispensing is present, the first and second chambers being separated by the piston.

In those devices, the gas generator is initially actuated in order to put the first chamber under pressure. This pressure rise created in the first chamber is transmitted by the piston to the liquid, thereby enabling the liquid to be dispensed to the outside of the device. While the liquid is being delivered, the piston moves in said device and the volume of the second chamber decreases progressively. The piston moves until it comes into abutment against the end wall of the device, when dispensing of the material terminates. In that type of device the piston at the end of its stroke serves to provide sealing for the system and the inside volume of the device thus remains under pressure. This remnant pressure can be a drawback under certain circumstances. In addition, with such systems, when a pipe is connected to the outlet of the device, the pipe remains full of liquid. The liquid present in the pipe does not participate in the desired function, thereby reducing the effectiveness of the device.

It would therefore be desirable to provide a device in which the inside volume can be depressurized at the end of dispensing the material, and that presents improved effectiveness by enabling the residual liquid to be purged.

Solutions have been proposed in the state of the art for this purpose. Nevertheless, those solutions can be relatively complex as a result of integrating a significant number of additional elements and of requiring certain additional steps to be performed in order to fabricate such devices, or they may present problems of reliability by presenting an untimely loss of sealing between the two chambers when the device is subjected to external mechanical stresses or when the liquid expands under the effect of heat.

The invention seeks to solve the above-mentioned problems of prior art devices.

OBJECT AND SUMMARY OF THE INVENTION

To this end, in a first aspect, the invention provides a device for dispensing a pressurized material, the device comprising a body defining a pressurizing chamber containing a gas generator, and a tank containing the material to be dispensed, said tank being defined by an end wall having an outlet orifice, the device further comprising a piston configured to move inside the body, the piston separating the pressurizing chamber from the tank, the gas generator being configured to trigger the dispensing of the material to the outside of the body through the outlet orifice by causing the piston to pass from a material-storage, first position to an end-of-material-dispensing, second position in which the piston faces the end wall;

the piston, when in the first position, presenting a housing that is closed by a fragile portion beside the pressurizing chamber and that is open beside the tank, the housing containing a striker element that is held in said housing and that defines a channel opening out into the tank, said striker element presenting a length greater than the length of the housing and projecting from the piston so that the fragile portion is broken by the striker element when the piston is in the second position.

The gas generator is configured to produce pressurizing gas that exerts pressure on the piston, which pressure is communicated by the piston for the material present in the tank. The outlet orifice is configured to allow the material to be delivered to the outside of the body as a result of the tank being pressurized by the gas generated in the pressurizing chamber.

The invention serves advantageously to provide a device that is reliable and of simple design, and that makes it possible, once the piston is in the second position at the end of dispensing the material, to depressurize the inside of the body automatically. Specifically, the design of the device of the invention merely requires a blind housing to be formed in the piston, which housing is closed beside the pressurizing chamber and open beside the tank and contains a striker element. When the piston is in the first position, the striker element projects from the piston into the tank. In addition, the striker element is of a length that is significant, being longer than the length of the housing. These characteristics of the striker element ensure that the fragile portion closing the housing is broken when the piston goes from the first position to the second position. Specifically, the gas generator is configured so that, when triggered, it causes the piston to move towards the end wall so as to move the striker element within the housing as a result of the projecting portion of the striker element impacting against the end wall. This movement of the striker element within the housing serves to break the fragile portion by impacting against it. When the fragile portion has broken, the pressurizing chamber is in communication with the tank and with the outlet orifice via the channel defined by the striker element so as to depressurize the inside of the body.

In an embodiment, when the piston is in the first position, the striker element has a first end facing the fragile portion and a second end projecting from the piston, the striker element presenting a cavity extending between its first and second ends and defining said channel.

Under such circumstances, when the piston goes from the first position to the second position, the impact of the second end with the end wall causes the striker element to move inside the housing so as to break the fragile portion by its first end impacting thereagainst. Once the fragile portion has broken, the pressurizing chamber is in communication with the tank and with the outlet orifice via the cavity defined by the striker element.

In an embodiment, the cavity is an inside cavity of the striker element.

In an embodiment, the striker element further comprises at least one first opening situated beside the first end and in communication with the inside cavity.

Such a characteristic serves advantageously to achieve effective depressurization in the event of the fragile portion shutting a portion of the inside cavity at the first end after breaking. Under such circumstances, depressurization takes place at least through the first opening.

In an embodiment, the striker element further comprises at least one second opening situated beside the second end and in communication with the inside cavity.

Such a characteristic further enhances discharging of the pressurized gas, in particular through the second opening.

In an embodiment, the striker element is also provided with a through slot extending between its first and second ends and in communication with the inside cavity.

Such a characteristic is advantageous insofar as the slot confers resilience to the striker element, making it easier to insert in the housing while fabricating the device. In addition, like the first and second openings described above, the through slot in communication with the inside cavity still further enhances depressurizing of the inside of the body.

In an embodiment, the striker element comprises a tubular wall surrounding the inside cavity, the first and second openings, when present, being through openings formed in the tubular wall.

In an embodiment, the cavity is defined by an internal spline present in the outer surface of the striker element.

In an embodiment, the striker element, when the piston is in the first position, comprises a first end facing the fragile portion and a second end projecting from the piston, said channel being defined by a volume situated between the striker element and a wall of the housing and extending between the first and second ends of the striker element.

Under such circumstances, when the piston goes from the first position to the second position, the impact of the second end against the end wall causes the striker element to move within the housing so as to break the fragile portion by impacting against it with the first end. Once the fragile portion has broken, the pressurizing chamber is in communication with the tank and with the outlet orifice via a volume defined by the striker element and by the wall of the housing.

In an embodiment, when the piston is in the first position, the housing comprises a first portion in which the striker element is held and situated beside the fragile portion, and a second portion situated beside the tank, which second portion is larger than the first portion.

The presence of the enlarged second portion of the housing still further enhances the discharging of the pressurized gas.

In an embodiment, the striker element has a portion of chamfered shape situated facing the fragile portion when the piston is in the first position.

Such a characteristic is advantageous since it makes it possible to break the fragile portion while tilting it so as to avoid it obstructing the channel once it has broken.

In an embodiment, the material for dispensing is in liquid form. In a variant, the material for dispensing is in the form of a foam or in powder form.

In an embodiment, the gas generator is a pyrotechnic gas generator. In a variant, the gas generator may be a tank of gas under pressure.

The present invention also provides a fire extinguisher formed by a device as described above in which the material for dispensing is an extinguishing agent. Nevertheless, the invention is not limited to using the above-described device as an extinguisher. In particular, in a variant, the above-described device could form a lubricator device in which the material for dispensing is a lubricant, such as lubricating oil.

BRIEF DESCRIPTION OF THE DRAWINGS

Other characteristics and advantages of the invention appear from the following description of particular embodiments of the invention, given as non-limiting examples and with reference to the accompanying drawings, in which.

DETAILED DESCRIPTION OF EMBODIMENTS

Figure 1:
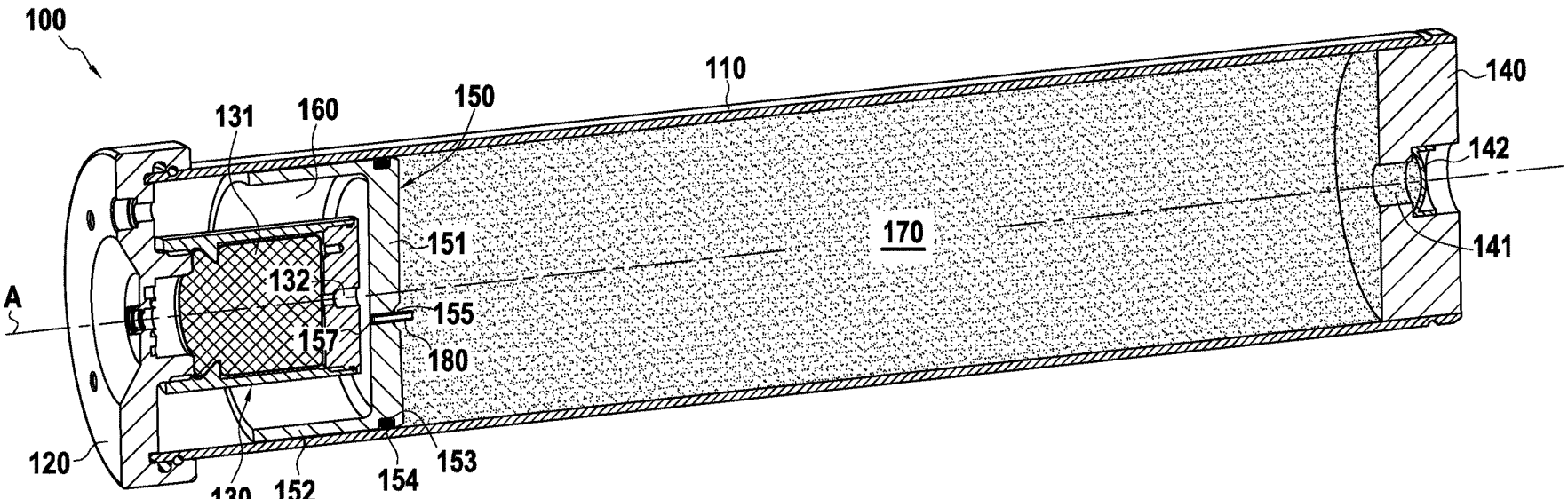
FIG. 1 shows a first example of a device of the invention with the piston in the first position.

FIG. 1 shows a device 100 for dispensing a pressurized material in accordance with a first embodiment of the invention. The piston 150 of the device 100 is shown in FIG. 1 while in its first position, corresponding to a position for storing the material in the device 100.

The device 100 has a body 110 of elongate shape. The body extends along an axis A. The body 110 is of axisymmetric shape about the axis A. In the example shown, the body 110 is cylindrical in shape. The body 110 of the device is closed at the first end by a first end wall 120 that has a pyrotechnic gas generator 130 fastened thereto, and at a second end it is closed by a second end wall 140. In a variant, it would be possible to use a tank of gas under pressure instead of the pyrotechnic gas generator. The axis A connects the first end wall 120 to the second end wall 140 and generally corresponds to the travel direction of the piston 150 in the body 110.

The piston 150 is present inside the body 110. When the piston 150 is in the first position, it defines inside the body 110 two chambers that are separated in sealed manner by said piston 150, one forming a pressurizing chamber 160 in which the gas generator 130 is present and the other forming a tank 170 storing the material that is to be delivered by the device 100. By way of example, the material that is to be delivered may be a liquid, a foam, or a powder material. The first end wall 120 defines the pressurizing chamber 160. The second end wall 140 defines the tank 170.

In the example shown, the pyrotechnic gas generator 130 comprises a pyrotechnic charge 131 that, on combustion, generates gas for pressurizing the pressurizing chamber 160. The gas generator 130 has an opening 132 centered on the axis A and including a flared portion through which the gas resulting from the combustion of the charge 131 can reach the pressurizing chamber 160. Such a pyrotechnic gas generator 130 is itself known, and is not described in greater detail herein.

The second end wall 140 of the device 100 is provided with an outlet orifice 141 that, in the example shown, is constituted by a through hole made in the second end wall 140. When the piston 150 is in the first position, as shown in FIG. 1, the outlet orifice 141 is closed by a membrane 142 that is configured to break when a determined pressure threshold in the tank 170 is exceeded so as to dispense the material that has been pressurized in this way to the outside of the device 100.

The piston 150 is of axisymmetric shape about the axis A and, by way of example, and as shown, it is cylindrical in shape. The piston 150 has a pressure application portion 151 extending transversely, e.g. perpendicularly, relative to the axis A. In the example shown, the pressure application portion 151 is in the shape of a disk. Furthermore, the piston 150 includes a skirt 152, which is cylindrical in shape in this example, extending from the portion 151 towards the first end wall 120. In a variant, it would be possible to use a piston without such a skirt. The portion 151 has a groove 153 that receives a gasket 154, e.g. of torroidal shape, that provides sealing between the pressurizing chamber 160 and the tank 170. The gasket 154 is positioned between the portion 151 and the body 110.

Figure 2:
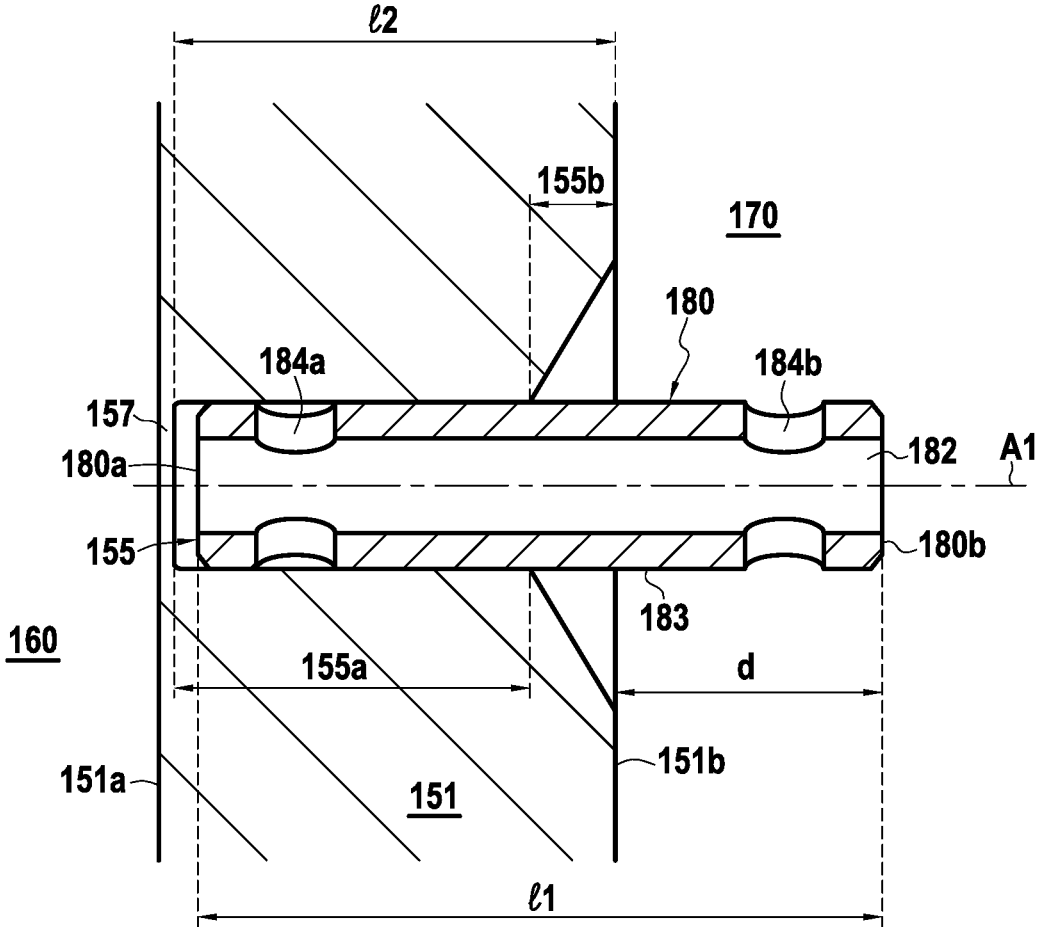
FIG. 2 is an enlarged view of the FIG. 1 device showing the housing and the striker element.

A housing 155 is provided in the piston 150 in the pressure application portion 151. When the piston 150 is in the first position, the housing 155 is a blind housing that is closed by a fragile portion 157 beside the pressurizing chamber 160 and that is open into the tank 170. When the piston 150 is in the first position, there is no communication between the pressurizing chamber 160 and the tank 170. In this first position, the chamber 160 and the tank 170 are separated in sealed manner by the piston 150, and in particular by the fragile portion 157 of the piston 150. A striker element 180 is held in the housing 155. FIG. 2 shows greater detail concerning the housing 155 and the striker element 180 while the piston 150 is in the first position.

With reference to FIG. 2, it can be seen that the housing 155 extends along an axis A1 parallel to the axis A. The fragile portion 157 in this example is in the form of a portion of small thickness. In the example shown, the fragile portion 157 is formed integrally with the pressure application portion 151. Thus, in the example shown, the pressure application portion 151 presents a fragile portion 157 of thickness that is smaller than the thickness of the portion 151 other than in said fragile portion 157. Furthermore, the pressure application portion 151 presents a first face 151*a* situated beside the pressurizing chamber 160 and a second face 151*b* situated beside the tank 170. The housing 155 comprises a first portion 155*a* in which the striker element 180 is held situated beside the fragile portion 157, and a second portion 155*b* that flares away from the first portion 155*a* and that is situated beside the tank 170. The diameter of the first portion 155*a* is less than the diameter of the second portion 155*b*. The term "diameter" is used herein to mean the greatest transverse direction measured perpendicularly to the axis A1 of the housing 155. In the example shown, the second portion 155*b* becomes progressively larger going towards the tank 170. In this example, the second portion 155*b* is in the shape of a conical countersink, but it would not go beyond the ambit of the invention for it to present some other shape.

The striker element 180 extends along a longitudinal axis corresponding to the axis A1 of the housing 155. The striker element 180 extends between a first end 180*a* facing the fragile portion 157 and a second end 180*b* projecting from the piston 150 and situated in the tank 170. The second end 180*b* projects from the piston 150 by a non-zero distance d measured between said second end 180*b* and the second face 151*b*. Unless mentioned to the contrary, the distance d is measured along the axis A1 of the housing 155. The striker element 180 is held tight in the first portion 155*a* of the housing 155. The striker element 180 exerts a clamping force that results from its contact with the wall of the housing 155. The clamping force exerted by the striker element 180 in the housing 155 serves to hold it in position while the piston 150 is in its first position. The striker element 180 may be inserted as a force fit in the housing 155. Because it is held in position, the striker element 180 does not break the fragile portion 157 before the generator 130 is actuated, e.g. as a result of the material shaking because of vibration or impacts to which the device 100 is subjected. Sealing between the tank 170 and the pressurizing chamber 160 is thus preserved before the device 100 is used.

In the configuration shown in FIG. 2, the first end 180*a* is spaced apart from the fragile portion 157 by a non-zero distance, however in a variant it would be possible for the first end 180*a* to be in contact with the fragile portion 157 when the piston 150 is in the first position. The striker element 180 presents a length $l_1$ that is longer than the length $l_2$ of the housing 155. This characteristic serves to ensure that, after impacting against the second end wall 140, the striker element can indeed break the fragile portion 157. Unless specified to the contrary, the lengths of the striker element and of the housing are measured along the axis A1 of the housing 155.

Figure 3:
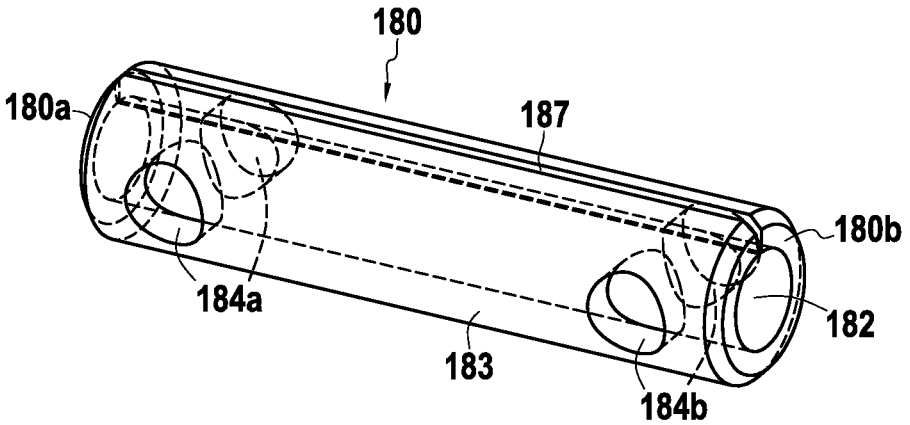
FIG. 3 shows, on its own, the striker element used in the FIG. 1 device.

The striker element 180 used has the structure of a split tube with the structure that is shown in FIG. 3. The striker element 180 has a tubular wall 183 defining an inside cavity 182. The inside cavity 182 is a through cavity that extends between the first end 180*a* and the second end 180*b*. The inside cavity 182 extends over the entire length $l_1$ of the striker element 180. In the example shown, the inside cavity 182 defines a channel opening out into the tank 170. As shown below, this channel serves, when the piston 150 is in the second position, to put the pressurizing chamber 160 into communication with the outlet orifice 141 so as to depressurize the device 100. The striker element 180 also presents at least two first openings 184*a* situated beside the first end 180*a*. The first openings 184*a* are through openings provided in the tubular wall 183 and they communicate with the inside cavity 182. The first openings 184*a* extend in a direction that is transverse relative to the longitudinal axis of the striker element 180, e.g. perpendicular thereto. The first openings 184*a* are diametrically opposite in the example shown, however these first openings could present other relative configurations in the ambit of the present invention. The striker element 180 also presents at least two second openings 184*b* situated beside the second end 180*b*. The second openings 184*b* are through openings made in the tubular wall 183 and they communicate with the inside cavity 182. The second openings 184*b* extend in a direction that is transverse relative to the longitudinal axis of the striker element 180, e.g. perpendicularly relative thereto. Like the first openings 184*a*, the second openings 184*b* are diametrically opposite in the example shown, but other relative configurations would be possible. In this example, the first/second openings 184*a*/184*b* are substantially circular in shape, however other shapes can be envisaged, e.g. such as polygonal shapes. In a variant that is not shown, the striker element could include a single first/second opening. The striker element 180 is also provided with a through slot 187 (see FIG. 3) that extends between its first and second ends 180*a* and 180*b* and that communicates with the inside cavity 182. The through slot 187 extends over the entire length $l_1$ of the striker element 180. The through slot 187 is a longitudinal slot extending along the longitudinal axis of the striker element 180. The through slot 187 is straight in shape in the example shown. The presence of the slot 187 is advantageous for imparting a degree of elasticity to the striker element, thereby making it easier to insert in the housing 155. The clamping force holding the striker element 180 in the housing 155 may be adapted as a function of the diameter of the split tube, of the thickness of the tubular wall 183, of the material used, or of the diameter of the housing 155.

Figure 4:
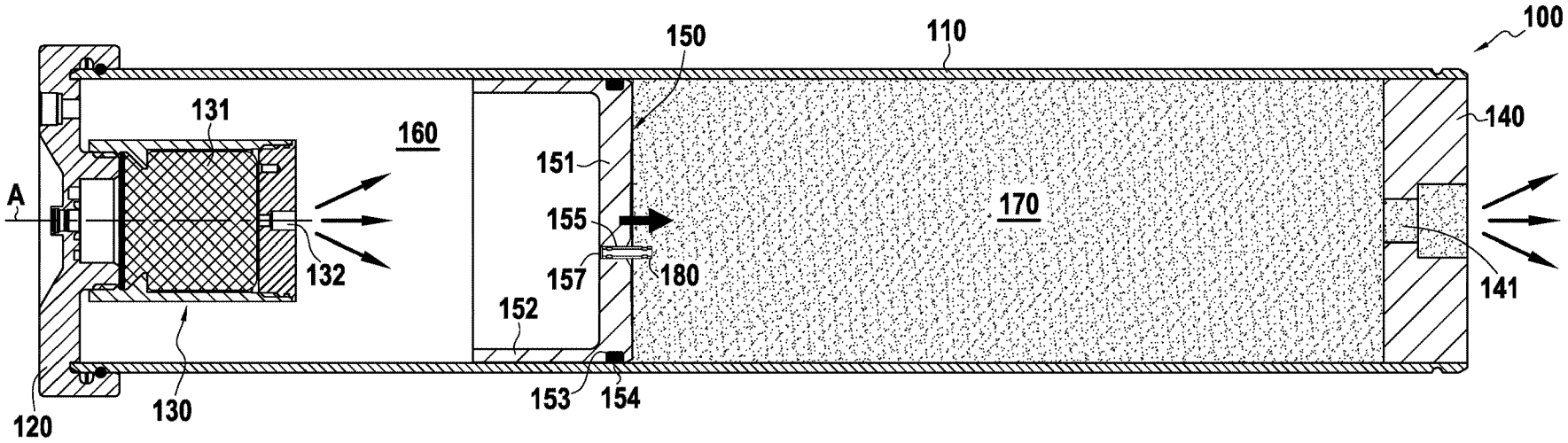
FIG. 4 shows the device of the example of FIG. 1 while dispensing the material with the piston passing from the first position to the second position.
Figure 5:
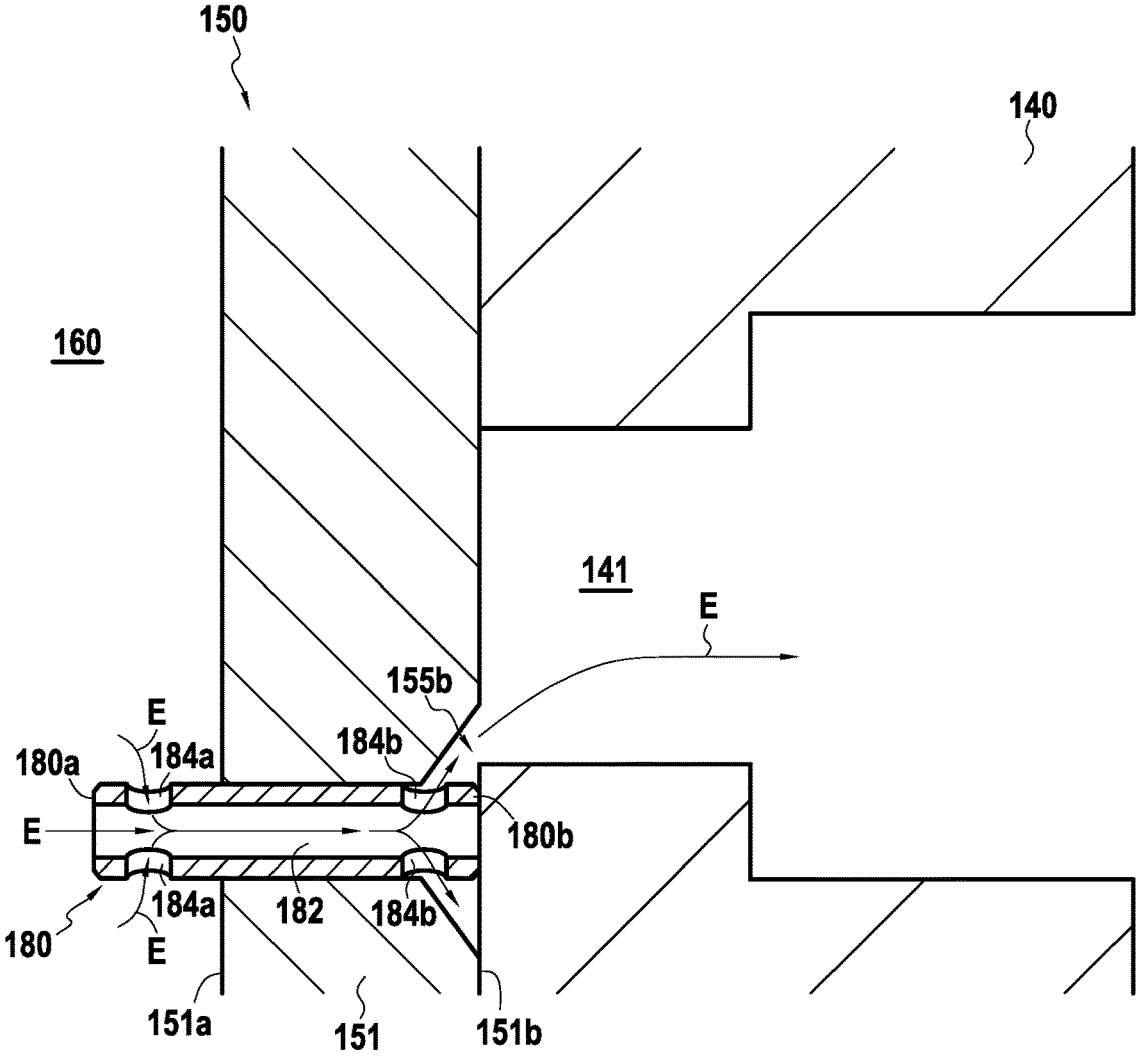
FIG. 5 is an enlarged view of the device in the example of FIG. 1 at the end of dispensing material, when the piston is in the second position.

With reference to FIGS. 4 and 5, there follows a description both of how the material is dispensed to the outside of the device 100, and also of the structure that is obtained once the piston 150 is in its second position.

FIG. 4 shows the above-described device 100 while it is dispensing the material, with the piston 150 passing from the first position to the second position. The gas generator 130 has just been triggered, the gas has pressurized the pressurizing chamber 160 and it is exerting a force on the piston 150. The force exerted by the gas on the piston 150 serves to move the piston towards the second end wall 140, thereby causing the material to be dispensed to the outside of the device 100 through the outlet orifice 141. The fragile portion 157 is configured so that it does not break under the effect of the pressure imparted by the gas generated in the pressurizing chamber 160.

At the end of dispensing the material, when the piston reaches the second position the second end 180*b* of the striker element 180 that projects beyond the piston 150 comes into contact with the second end wall 140. As a result of this impact, the striker element 180 slides inside the housing and its first end 180*a* thus breaks the fragile portion 157 by impact. The force exerted by the second end wall 140 on the striker element 180 during the impact is strictly greater than the clamping force that holds the striker element 180 in the housing 155 so as to ensure that the striker element 180 is pushed into the housing.

After impact, the structure shown in FIG. 5 is obtained, in which the striker element 180 has been pushed into the housing and has broken the fragile portion. When the piston 150 is in the second position, it faces the second end wall 140. The second face 151*b* of the piston may be in abutment against the second end wall 140 when the piston 150 is in the second position. The second end 180*b* of the striker element 180 may be in abutment against the second end wall 140 when the piston 150 is in the second position. In the embodiment shown, the striker element 180 is not situated in line with the outlet orifice 141 but is offset therefrom. However, it should be observed that the enlarged second portion 155*b* of the housing opens out in register with the outlet orifice 141 when the piston 150 is in the second position. In the configuration shown, the second openings 184*b* and the slot 187 open out into the enlarged second portion 155*b* of the housing 155 when the piston 150 is in the second position. FIG. 5 shows the path E along which the pressurizing gas is discharged to the outside of the device 100. This gas passes through the first opening 184*a*, the inside cavity 182, the through slot 187, and the second openings 184*b* before finally discharging through the outlet orifice 141. As mentioned above, the presence of the first openings 184*a* serves to achieve effective depressurizing, even in the event of the fragile portion 157, after being broken, shutting off a portion of the inside cavity 182 at the first end 180*a*. The device thus makes it possible to depressurize the inside of the body 110 automatically at the end of dispensing the material. In addition, when a dispensing channel (not shown) is fastened to the outside of the device 100 at the outlet orifice 141, the content of this channel full of material is purged by the gas discharging to the outside of the device. As a result, a greater quantity of material contributes effectively to the intended function and the effectiveness of the device is thus improved.

FIGS. 6 to 11 show variant structures for striker elements that can be used in the context of the invention.

Figure 6:
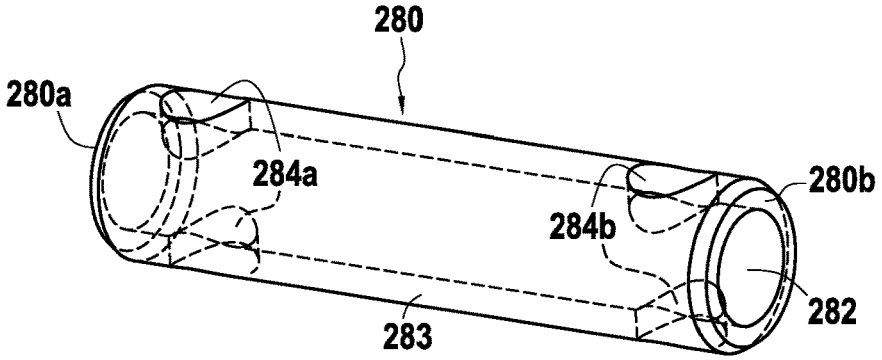
FIGS. 6 to 11 show, on their own, variant striker elements suitable for use in the device of the invention.

The striker element 280 shown in FIG. 6 is in the form of a tube. It has a tubular wall 283 defining an inside cavity 282 that extends between its first end 280*a* and its second end 280*b*. It does not have a longitudinal slot, but it presents two first openings 284*a* situated beside the first end 280*a* and two second openings 284*b* situated beside the second end 280*b*.

Figure 7:
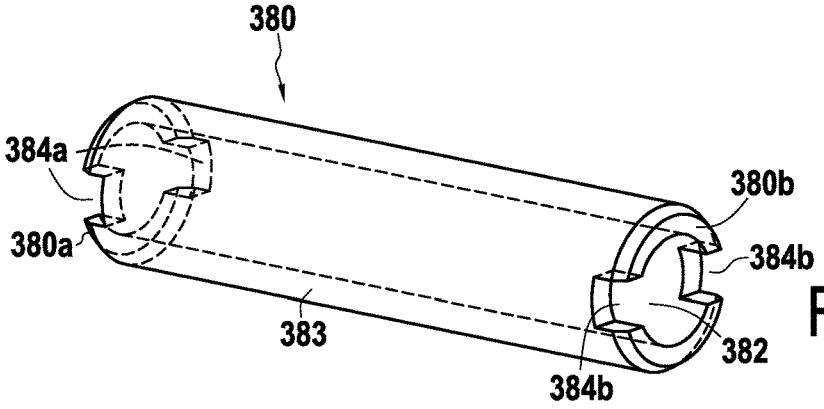

The striker element 380 shown in FIG. 7 is in the form of a tube. It has a tubular wall 383 defining an inside cavity 382 that extends between its first end 380*a* and its second end 380*b*. It too has no longitudinal slot, but it presents two first openings 384*a* situated at the first end 380*a* and two second openings 384*b* situated at the second end 380*b*. In the example shown, the first and second openings 384*a* and 384*b* are in the form of notches.

Figure 8:
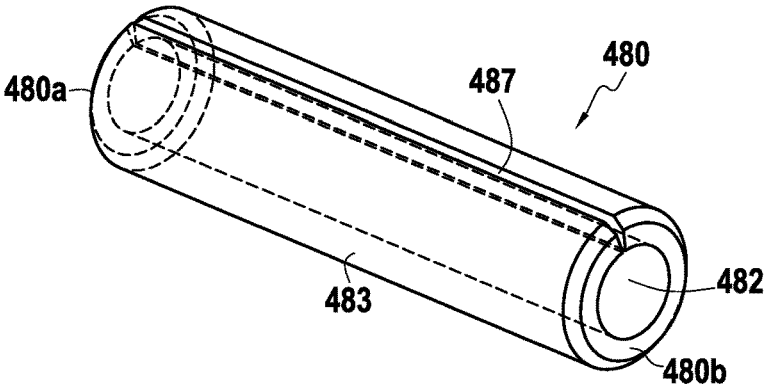

The striker element 480 shown in FIG. 8 is in the form of a tube. It has a tubular wall 483 defining an inside cavity 482 that extends between its first end 480*a* and its second end 480*b*. It does not have first and second openings, but it does present a longitudinal slot 487. When the piston is in the second position, gas is discharged to the outlet orifice at least through the longitudinal slot 487.

Figure 9:
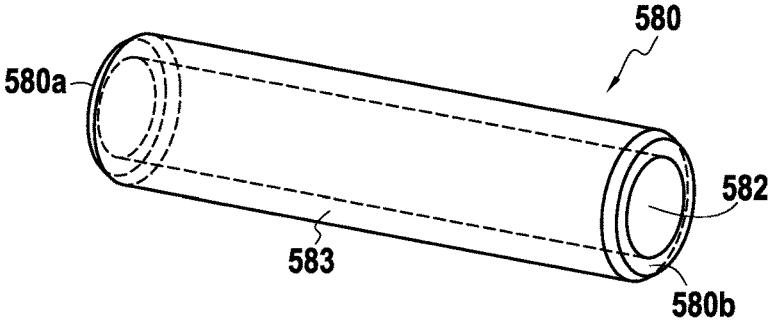

The striker element 580 shown in FIG. 9 is in the form of a tube. It has a tubular wall 583 defining an inside cavity 582 extending between its first end 580*a* and its second end 580*b*. It does not have first or second openings nor does it have a longitudinal slot. When the piston is in the second position, gas is discharged through the outlet orifice via the inside cavity 582. Such a striker element 580 can be used in a device of the type shown in FIG. 1 by providing the second end wall 140 with one or more portions in relief forming abutments and serving to leave a gap between the second face 151*b* of the piston 150 and the outlet orifice 141 when the piston is in the second position. As a result, even when the inside cavity 182 is not in register with the outlet orifice 141 in the second position, gas can be discharged through the inside cavity 182 because of the gap provided in this way. The striker element 580 may also be used in other types of device of the invention as described in detail below.

Figure 10:
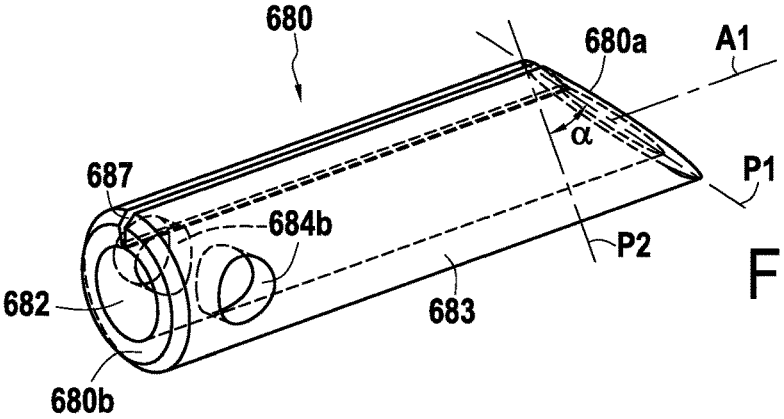

The striker element 680 shown in FIG. 10 is in the form of a tube having a portion of chamfered shape at its first end 680*a*. In other words, the plane P1 containing the first end 680*a* forms a non-zero angle $\alpha$ with the plane P2 perpendicular to the axis A1 of the striker element. The striker element 680 has a tubular wall 683 defining an inside cavity 682 extending between its first end 680*a* and its second end 680*b*. Breaking the fragile portion with the chamfered portion 680*a* serves to obtain a break in which the fragile portion is tilted, thereby ensuring that it does not obstruct the inside cavity 682 once broken. The striker element does not have a first opening, but it does present a longitudinal slot 687 together with second openings 684*b*. When the piston is in the second position, gas is discharged through the outlet orifice via the inside cavity 682, the longitudinal slot 687, and the second openings 684*b*. In a variant, it would be possible to use a striker element having a chamfered portion as shown, but without any second opening or any longitudinal slot.

Figure 11:
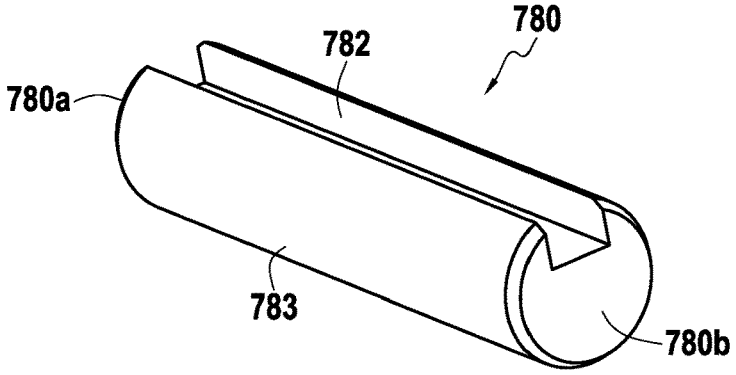

FIG. 11 shows a variant striker element 780 that is not tubular in shape. In this variant, the striker element 780 includes an internal spline 782 in its outer surface 783, which spline defines the channel. The spline 782 extends between the first end 780*a* and the second end 780*b* and it defines a cavity in the striker element. When the piston is in the second position, gas is discharged to the outlet orifice through the spline 782.

Figure 12:
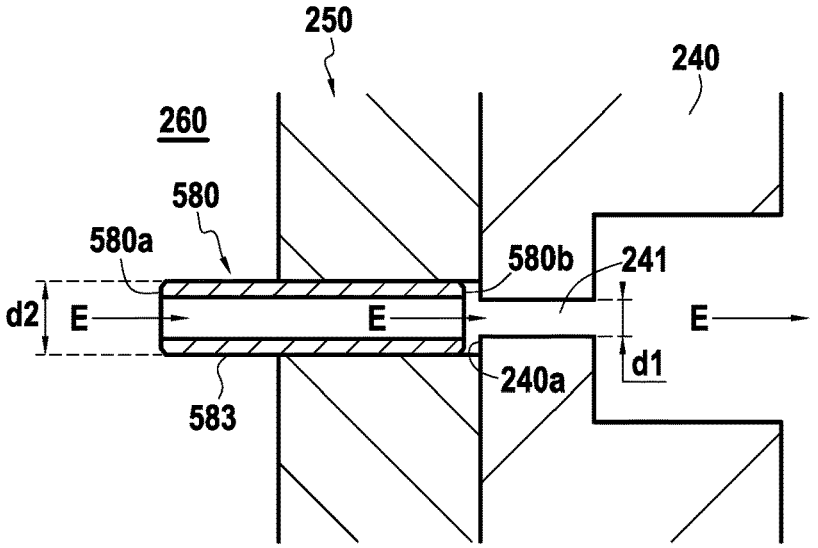
FIG. 12 is an enlarged view of a variant of the device of the invention using the FIG. 9 striker element, with the piston shown in the second position.

FIG. 12 shows a variant of the device of the invention in which the housing does not have an enlarged second portion, unlike the device shown in FIG. 1. In the variant shown in FIG. 12, the striker element 580 is as shown in FIG. 9. The striker element 580 presents an outside diameter d2 that is greater than the diameter d1 of the outlet orifice 241. Furthermore, the striker element 580 is situated in line with the outlet orifice 241 when the piston 250 is in the second position. More precisely, the inside cavity 582 opens out into the outlet orifice 241 when the piston 250 is in the second position. In this configuration, when the piston 250 reaches the second position, the second end 280*b* of the tubular wall 583 comes into contact with the portion 240*a* of the second end wall 240 surrounding the outlet orifice 241, thereby breaking the fragile portion and allowing gas to be discharged from the pressurizing chamber 260 along the path E through the outlet orifice 241.

Figure 13:
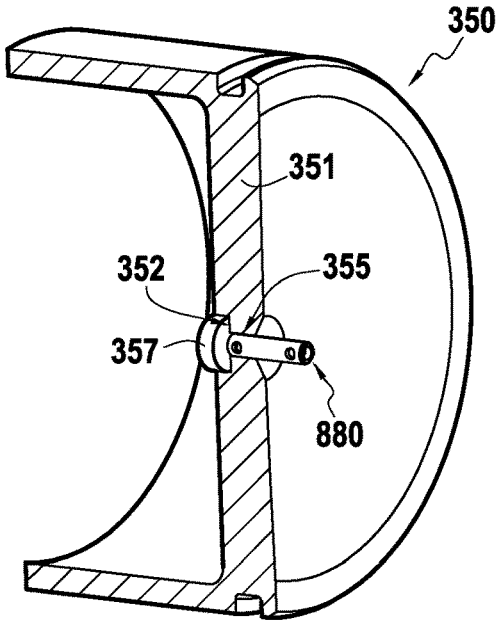
FIG. 13 shows a variant piston suitable for use in a device of the invention.

FIG. 13 shows a variant piston 350 in the first position in which the fragile portion 357 is no longer formed integrally with said piston 350, but on the contrary, is in the form of a fitted element. In the example shown, the striker element 880 is held in the first housing 355, which is open beside the tank. The piston also has a second housing 352 that is open beside the pressurizing chamber 360 in which a nut 357 is present that is screwed to the striker element 880. The striker element 880 presents a thread beside its first end that co-operates with tapping formed inside the nut 357. The nut 357 closes the first housing 355 beside the pressurizing chamber. On impact of the striker element 880 against the second end wall, the striker element separates from the tapping in the nut and passes through it in order to allow gas to be discharged. In a variant, the fragile portion could be fitted to the secured piston by welding.

Figure 14:
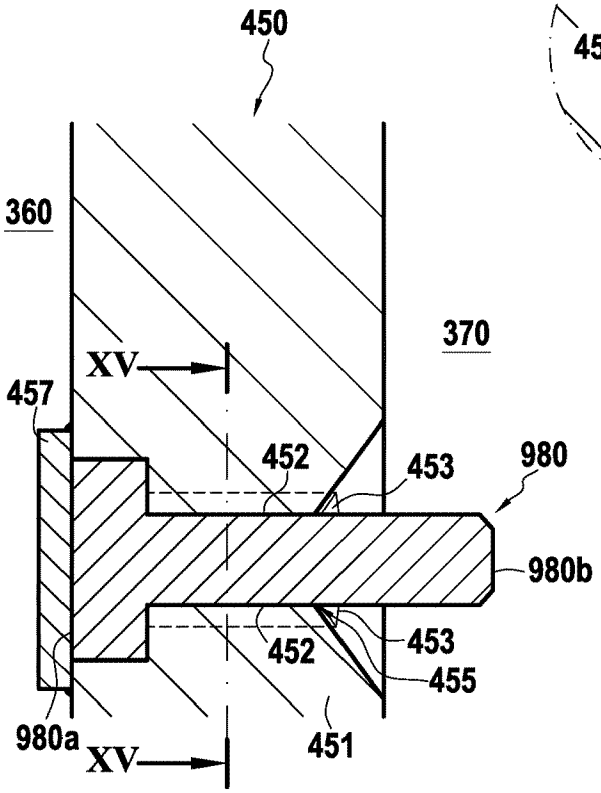

FIG. 14 shows a variant device of the invention. In the configuration shown in FIG. 14, the piston 450 is in its first position. The example of FIG. 14 is one in which the striker element 980 is solid and does not present an internal spline in its outer surface. When it is in the first position, the piston 450 keeps the pressurizing chamber 360 separate from the tank 370. The pressure application portion 455 of the piston 450 presents a blind housing 455 in which the striker element 980 is present. In the example shown, the housing 455 is closed beside the pressurizing chamber 360 by a fragile portion 457 that is welded to the piston 450. The housing 455 also presents an opening that opens out into the tank 370. The first end 980*a* of the striker element 980 is situated beside the fragile portion 457, and the second end 980*b* of the striker element 980 projects from the piston 450 into the tank 370.

Figure 15:
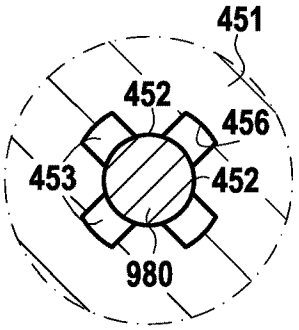

In the example shown, the piston 450 defines clamping portions 452 that are to exert a clamping force on the striker element 980 so as to hold it in position in the housing 455 while the piston 450 is in the first position. As shown in FIG. 15, the clamping portions 452 are in the form of projecting portions in relief. The portions in relief 452 are distributed around the axis of the housing. The portions in relief 452 may optionally be uniformly distributed around the axis of the housing. Channels 453 are situated between the portions in relief 452. A pair of adjacent portions in relief 452 define a channel 453 that extends along the axis of the housing 455. Each channel 453 is situated between the striker element 980 and a wall 456 of the housing 455.

Figure 16:
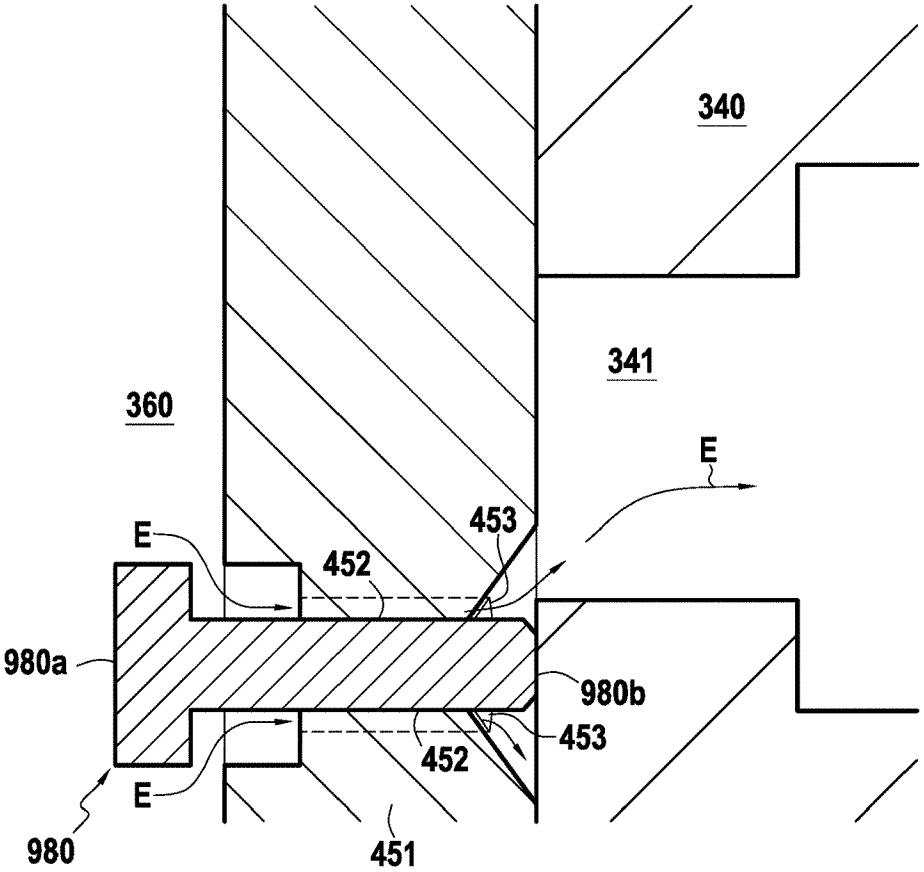
FIGS. 14 to 16 show a variant of the device of the invention.

When the piston is in the second position and the first end 980*a* of the striker element 980 has broken the fragile portion 457, gas escapes along the path E via the channels 453 so as to be discharged to the outside of the device through the outlet orifice 341 in the second end wall 340 (FIG. 16).

The invention claimed is:

1. A device for dispensing a pressurized material, the device comprising a body defining a pressurizing chamber containing a gas generator, and a tank containing the material to be dispensed, said tank being defined by an end wall having an outlet orifice, the device further comprising a piston configured to move inside the body, the piston separating the pressurizing chamber from the tank, the gas generator being configured to trigger the dispensing of the material to the outside of the body through the outlet orifice by causing the piston to pass from a material-storage, first position to an end-of-material-dispensing, second position in which the piston faces the end wall;

the piston, when in the first position, presenting a housing that is closed by a fragile portion beside the pressurizing chamber and that is open beside the tank, the housing containing a striker element that is held in said housing and that defines a channel opening out into the tank, said striker element presenting a first length greater than a second length of the housing and projecting from the piston so that the fragile portion is broken by the striker element when the piston is in the second position.

2. A device according to claim 1, wherein, when the piston is in the first position, the striker element has a first end facing the fragile portion and a second end projecting from the piston, the striker element presenting a cavity extending between its first and second ends and defining said channel.

3. A device according to claim 2, wherein the cavity is an inside cavity of the striker element.

4. A device according to claim 3, wherein the striker element further comprises at least one first opening situated beside the first end and in communication with the inside cavity.

5. A device according to claim 3, wherein the striker element further comprises at least one second opening situated beside the second end and in communication with the inside cavity.

6. A device according to claim 3, wherein the striker element is also provided with a through slot extending between the first end and the second end thereof and in communication with the inside cavity.

7. A device according to claim 3, wherein the striker element comprises a tubular wall surrounding the inside cavity, at least one first opening and at least one second opening, said at least one first opening and at least one second opening being through openings formed in the tubular wall.

8. A device according to claim 2, wherein the cavity is defined by an internal spline present in the outer surface of the striker element.

9. A device according to claim 1, wherein the striker element, when the piston is in the first position, comprises a first end facing the fragile portion and a second end projecting from the piston, said channel being defined by a volume situated between the striker element and a wall of the housing and extending between the first and second ends of the striker element.

10. A device according to claim 1, wherein, when the piston is in the first position, the housing comprises a first portion in which the striker element is held and situated beside the fragile portion, and a second portion situated beside the tank, which second portion is larger than the first portion.

11. A device according to claim 1, wherein the striker element has a portion of chamfered shape situated facing the fragile portion when the piston is in the first position.

12. A fire extinguisher formed by a device according to claim 1, wherein the material for dispensing is an extinguishing agent.

* * * * *